US006062467A

United States Patent [19]

Ours et al.

[11] Patent Number: 6,062,467

[45] Date of Patent: May 16, 2000

[54] DISPENSING ASSEMBLY FOR A LINED CARTON AND PROCESS AND APPARATUS THEREOF

[75] Inventors: David C. Ours, Marshall; James O. Robotham, Nashville; David L. Bradley, Battle Creek, all of Mich.

[73] Assignee: Kellogg Company, Battle Creek, Mich.

[21] Appl. No.: 09/050,533

[22] Filed: Mar. 30, 1998

Related U.S. Application Data

[60] Provisional application No. 60/069,859, Dec. 17, 1997.

[51] Int. Cl.[7] ..... B65D 5/74

[52] U.S. Cl. ..... 229/117.3; 229/117.31; 229/117.34; 229/125.04; 493/87; 493/95; 493/129; 493/907

[58] Field of Search ..... 229/117.27, 117.3, 229/117.31, 117.32, 117.33, 117.34, 214, 215, 221, 125.04; 493/87, 95, 128, 129, 907

[56] References Cited

U.S. PATENT DOCUMENTS

| | | | |
|---|---|---|---|
| 2,536,529 | 1/1951 | Bergstein . | |
| 2,593,778 | 4/1952 | McGinnis . | |
| 2,701,679 | 2/1955 | Goldstein | 229/215 |
| 2,820,585 | 1/1958 | Nerenberg et al. . | |
| 2,998,788 | 9/1961 | Back et al. . | |
| 3,127,082 | 3/1964 | Meyer-Jagenberg . | |
| 3,250,436 | 5/1966 | Kurtz . | |
| 3,292,839 | 12/1966 | Pike . | |
| 3,344,972 | 10/1967 | Robinson et al. . | |
| 3,426,955 | 2/1969 | Olson . | |
| 3,484,034 | 12/1969 | Sternau . | |
| 3,605,578 | 9/1971 | Sternau . | |
| 3,768,719 | 10/1973 | Johnson . | |
| 3,879,247 | 4/1975 | Dickey . | |
| 4,565,315 | 1/1986 | Wagner et al. . | |
| 4,707,213 | 11/1987 | Mohr et al. . | |
| 4,787,194 | 11/1988 | Lancaster et al. . | |
| 4,944,406 | 7/1990 | Zehnal . | |
| 4,990,200 | 2/1991 | Heinz . | |
| 5,012,959 | 5/1991 | Gordon . | |
| 5,014,888 | 5/1991 | Bryan . | |
| 5,117,613 | 6/1992 | Pfaffmann . | |
| 5,429,297 | 7/1995 | Walsh . | |
| 5,531,376 | 7/1996 | Brink et al. . | |
| 5,653,383 | 8/1997 | Adachi et al. . | |

FOREIGN PATENT DOCUMENTS

| | | |
|---|---|---|
| 92953 | of 0000 | Denmark . |
| 1275802 | of 0000 | United Kingdom . |

OTHER PUBLICATIONS

The Wiley Encyclopedia of Packaging Technology, Bakker, John Wiley & Sons. 1986.

*Primary Examiner*—Gary E. Elkins
*Attorney, Agent, or Firm*—Fulbright & Jaworski, LLP

[57] ABSTRACT

Dispensing assembly for a carton with a dispensing opening in a side wall thereof and a separate liner therein. The pour spout is pivotably mounted to the dispensing opening between an open and closed position and includes a front panel. The liner is bonded to the front panel so that when the front panel is initially opened, that portion of the liner bonded to said front panel separates from the rest of the liner, providing access to the interior thereof.

18 Claims, 11 Drawing Sheets

DISPENSING ASSEMBLY FOR A LINED CARTON AND PROCESS AND APPARATUS THEREOF

RELATED APPLICATION

This application claims priority from Provisional application Ser. No. 60/069,859 filed Dec. 17, 1997, which is incorporated herein by reference.

This invention relates to the packaging of dry particulate foods such as ready-to-eat ("RTE") cereal. More specifically, this invention relates to lined cartons with reclosable dispensing means connected to the liner in such a way that a portion thereof is separated from the liner upon initial opening to provide access to the contents of the carton.

BACKGROUND

The use of cartons with liner bags for dry particulate foods such as RTE cereal is well known. Such cartons are usually formed from a blank of paperboard or similar material comprising sidewalls and top and bottom flaps. The liner is a plastic or coated paper bag which holds the particulate food. The liner can be filled and sealed before or after being placed inside an open top carton, the top flaps of which are then folded and sealed.

Access to the contents of such cartons involves breaking the seal between the top flaps of the carton and pulling open the sealed liner bag. Resealing is often difficult and incomplete leading to a loss of freshness of the product. RTE cereal, for example, has a low moisture content and readily absorbs moisture from the air leading to a loss of crispness.

Dispensing devices such as pour spouts have been proposed to control the discharge of particulate product and minimize exposure to the atmosphere, however, when a carton with a pour spout contains a filled and sealed liner bag, the bag must be manually torn or cut with a knife or scissors when the spout if first opened. This arrangement has several drawbacks not the least of which is manually opening the liner bag. Once opened, and as the contents are depleted, the liner bag and its contents slide and shift positions in the carton which can cause the opened portion of the liner to become misaligned with the pour spout opening thereby hindering dispensing of product from the carton. This also causes product to drop between the carton and the liner.

SUMMARY OF THE INVENTION

The present invention is directed towards an improved food carton with a pivotable pour spout mounted to a dispensing opening. A front panel of the pour spout is bonded to a portion of the liner bag and, when initially opened, that portion partly separates from the rest of the liner thereby providing access to the contents of the carton. Thus, as the pour spout pivots to open for the first time, the liner bonded to the front panel separates to create an opening while remaining integral with the liner along the pivot axis.

Because the portion of the liner that separates corresponds approximately to the size of the dispensing opening, and remains part of the liner as well as bonded to the front panel, closure of the pour spout minimizes contact of the contents with the outside atmosphere and maintains alignment between the liner opening and the pour spout opening.

The liner can also be bonded adjacent the dispensing opening to further maintain alignment.

DESCRIPTION OF THE DRAWINGS

The present invention will be more fully understood from the following description and the accompanying drawings wherein.

DESCRIPTION

Figure 1B:
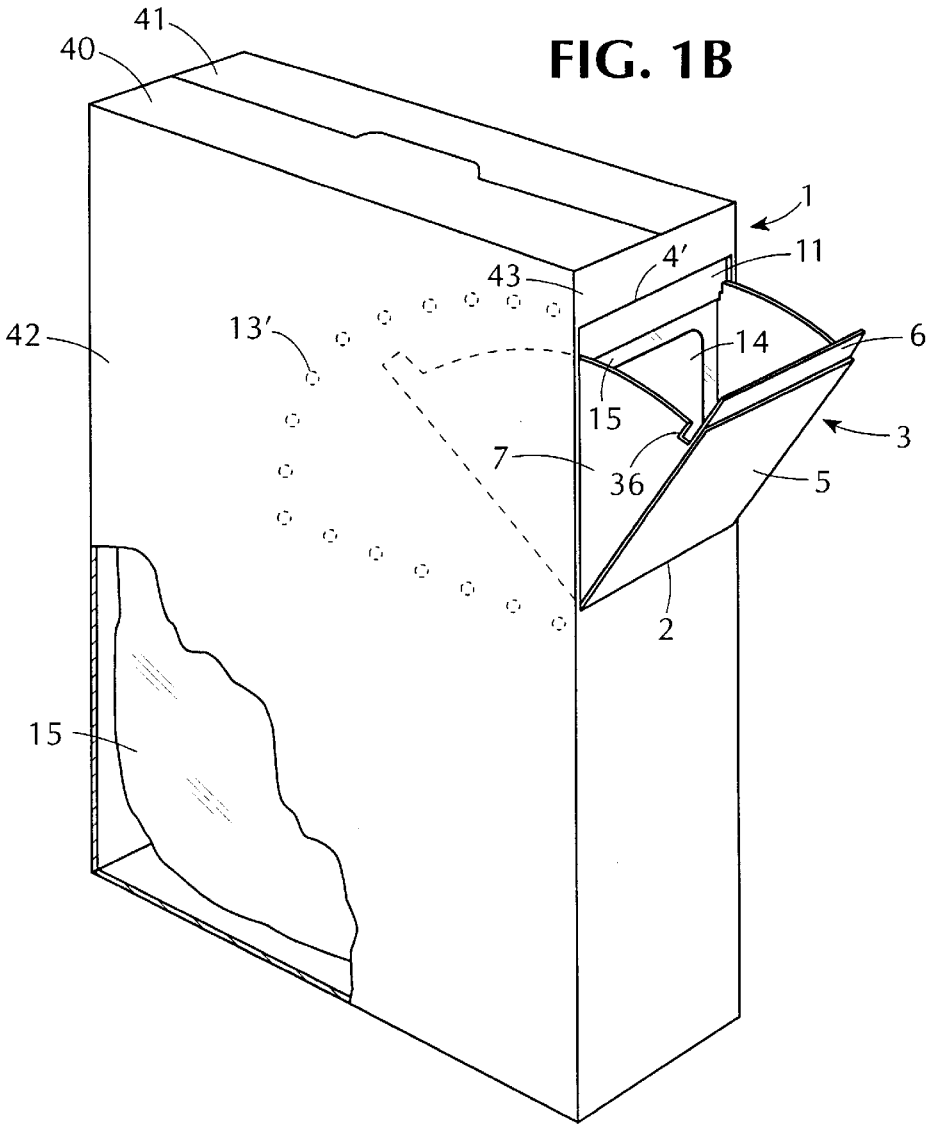
FIGS. 1A and 1C are side views and FIG. 1B is a perspective view of the dispensing assembly of the invention shown partly open.

Numerous carton and pour spout combinations are known. These include pour spouts attached to or integral with carton blanks. U.S. Pat. No. 5,012,959 is illustrative of the first type and shows a plastic pour spout fitment in a precut dispensing opening of a paperboard carton. The fitment is attached by an adhesive or a plurality of rivets. Pour spout fitments may be made from any number of materials including, polyethylene, polypropylene, polystyrene, nylon ABS, paperboard and the like.

A carton blank with an integral pour spout is shown in U.S. Pat. No. 5,531,376.

It is preferred to use a conventional paperboard carton with a separate or integral pour spout and a conventional plastic liner bag that is filled and sealed before or after being inserted into an open top carton. Numerous apparatus and processes using such materials and techniques for packaging RTE cereal are known and available.

In carrying out the present invention, a portion of the liner bag is brought into contact and bonded with the front panel of a pour spout mounted in a dispensing opening in a side panel of the carton.

The preferred bonding medium is a hot melt adhesive. If the liner is in the carton, open and unfilled, simple means can be employed to clamp the liner and the front panel together and apply heat to heat seal to two surfaces together. Normally, in this embodiment, the hot melt adhesive is first applied in the desired pattern to the interior of the front panel of the pour spout.

If the liner is filled and sealed and already in a sealed carton, reduced pressure means such as a simple vacuum enclosure can be used to bring about a sealing contact between the liner and the front panel of the pour spout.

An activatable hot melt adhesive is positioned in the desired pattern between the liner and the front panel and externally activated by delivering bonding energy to the interface. This can be done by including a heat generating substance in or with the hot melt adhesive that will generate heat to activate the adhesive. Such substances include metal foils such as aluminum foil laminated on one or both sides to a hot melt adhesive, metal salts such as magnesium chloride, chromium nitrate, aluminum chloride and the like, mixed with a hot melt adhesive or metal particles such as iron or aluminum powder mixed with or flocked onto a hot melt adhesive applied in the desired pattern to the front panel.

When using magnetizable particles such as iron, a magnet can be employed to orient the particles and promote bonding with the liner. Metal salts and metal particles are used in amounts sufficient to activate the adhesive when external bonding energy is applied.

Hot-melt adhesives are 100% solids and are applied in hot, molten form. They set fast when heat is removed and can be preapplied and reactivated later by the application of heat. Hot melt adhesives are typically formulated with a backbone polymer such as ethylene-vinyl acetate or polyethylene. The main polymer is usually let down with a diluent such as wax to improve melt flow properties. Antioxidants are a component since the adhesive is applied hot and is subject to oxidation. Tackifiers improve hot tack and viscosity. Other materials influence melt temperature. Added colorants can make the adhesive more visible.

Hot-melt adhesives are readily available from numerous sources. INSTANT LOK® & hot melt adhesives from National Starch and Chemical Corporation of Bridgewater N.J. 08807 are suitable for use in the invention.

Metal foil laminates are preferred for ease of application and activation. A typical metal foil laminate includes aluminum foil, generally vacuum metalized aluminum on a polyester film, with a linear low density polyethylene adhesive on one or both sides. Curwood Inc., of Oshkosh, Wis. 54903, provides CURLAM® Grade 5432 film with adhesive on one side. It is preferred to coat both sides of the film with an adhesive which enables the use of induction heating to bond the foil laminate to the front panel and the liner at the same time.

Induction heating equipment is widely used in the packaging field and suitable units for use in the invention are available from Lepel Corporation of Edgewood, N.Y. 11717 and Amertherm, Inc. of Scottsville, N.Y. 14546.

The intensity and duration of the induction field required to bond the liner to the front panel depends on the composition of the heat activatable adhesive. For example, an aluminum foil laminated with linear, low density polyethylene generally achieves its sealing temperature in 0.9 to 1.2 seconds when exposed to a Lepel, LEPAK, Jr. 750 watt induction sealer. An adhesive including a resin base with about 5 to 10 weight percent metallic salt, such as chromium nitrate or aluminum chloride, generally reaches its sealing temperature in under 2.0 seconds when placed in an 800 watt GE microwave oven operating at 900 to 1100 kHz.

Other induction heating systems and heat activatable adhesives can be adopted to the present invention. For example, an induction heating system for sealing packages using magnetic susceptible particles and heat softenable adhesives and high frequency alternating magnetic fields is disclosed in U.S. Pat. No. 3,879,247 which is incorporated herein by reference. Polymer systems for sealing containers which can be activated by electromagnetic energy frequencies of 0.1–30,000 MHZ, including radio frequency and microwave heating, are disclosed in U.S. Pat. No. 4,787,194 which is incorporated herein by reference. RF sealable, non-foil acrylate based polymers for packaging applications are disclosed in WO 95/03939 which is also incorporated herein by reference.

Heat sealing the liner to the front panel of the pour spout locally weakens the liner at the margins of the heat seal area which facilitates separation of a portion of the liner. This effect can be enhanced by attaching a laminate metal foil laminate to a raised area on the front panel with an overhang, that is, the size of the raised area is slight smaller than the area of the metal foil laminate. The edges of the foil laminate extend over the outside perimeter of the raised area and come in contact with the liner without contact with the front panel. When the foil is exposed to an induction field, the heat produced in the overhang area creates a thinned area or score line mirroring the shape of the overhang area.

Other methods of scoring a liner include applying a metal containing substance, such as a metal foil or a metal ink, directly to the liner, and then exposing the liner to an induction field.

Figure 1A:
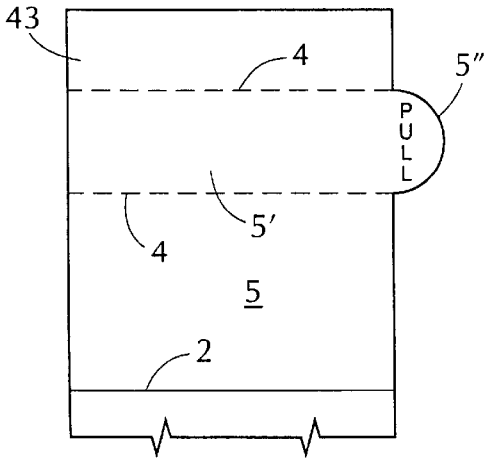
Figure 1C:
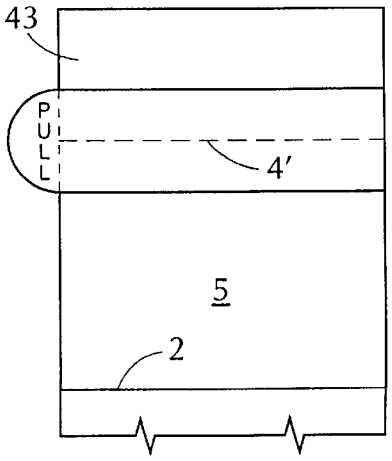
Figure 2:
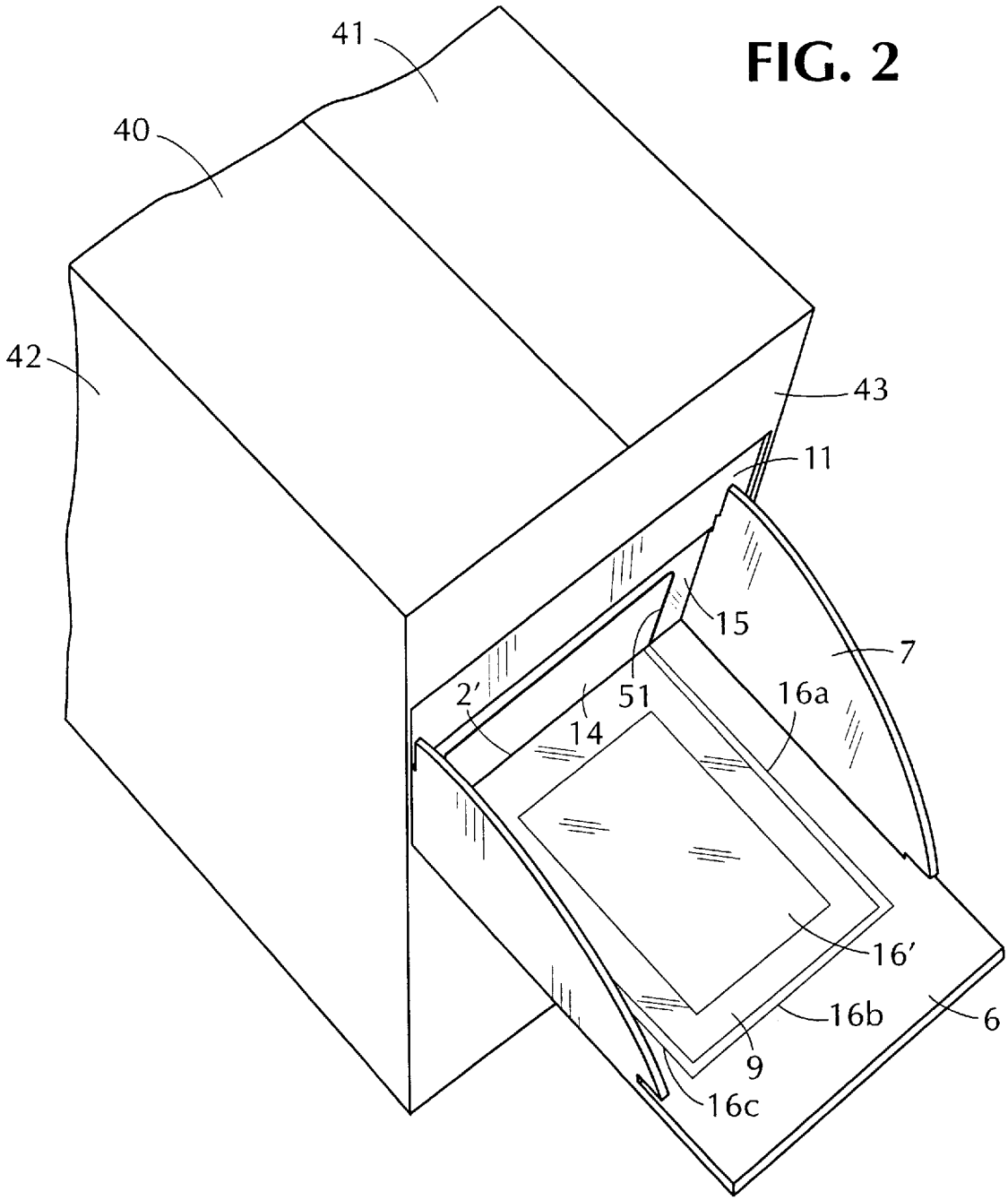
FIG. 2 is a perspective view of the dispensing assembly of the invention shown fully open.

Referring now to FIGS. 1–3 of the drawing, the dispensing assembly of the invention, shown generally by reference numeral 3, is mounted to a dispensing opening in carton 1. Carton 1 includes side walls 42, end walls 43 and top flaps 40 and 41. A sealed plastic liner bag 15 with product is in carton 1. Flap member 5 which is perforated from end wall 43 so as to pivot around axis 2 carries the pour spout which includes front panel 6 and side panels 7.

Access to pour spout 3 can be gained, in one embodiment shown in FIG. 1A, by removing strip 51 between perforated lines 4 via tab 5" thus is exposing an upper portion of front panel 6 as shown in FIG. 1B. Alternatively, flap 5 can abut cut line 4' in end wall 43 as shown in FIG. 1C. Line 4' is covered by a peal off tape which can be removed for initial opening of the pour spout 3.

Figure 5:
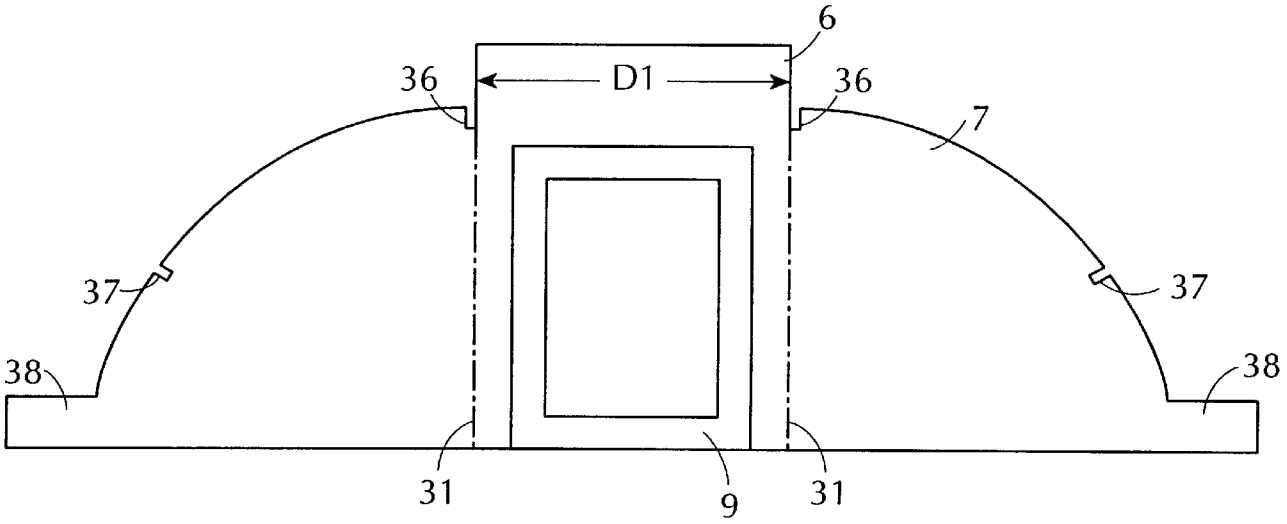
FIG. 5 is a plan view of a pour spout assembly laid flat with its interior surfaces facing upwards.

As shown in FIG. 5, the pour spout assembly has side panels 7 joined to front panel 6 along fold lines 31. Side panels 7 have notches 36 and 37 for defining the closed and open position of the spout 3 as well as tabs 38 which prevent complete removal of the pour spout in the event the position defined by notches 37 is exceeded. Front panel 6 is secured to flap 5 using a suitable adhesive such as a hot melt adhesive while the box blank is still flat.

Figure 3A:
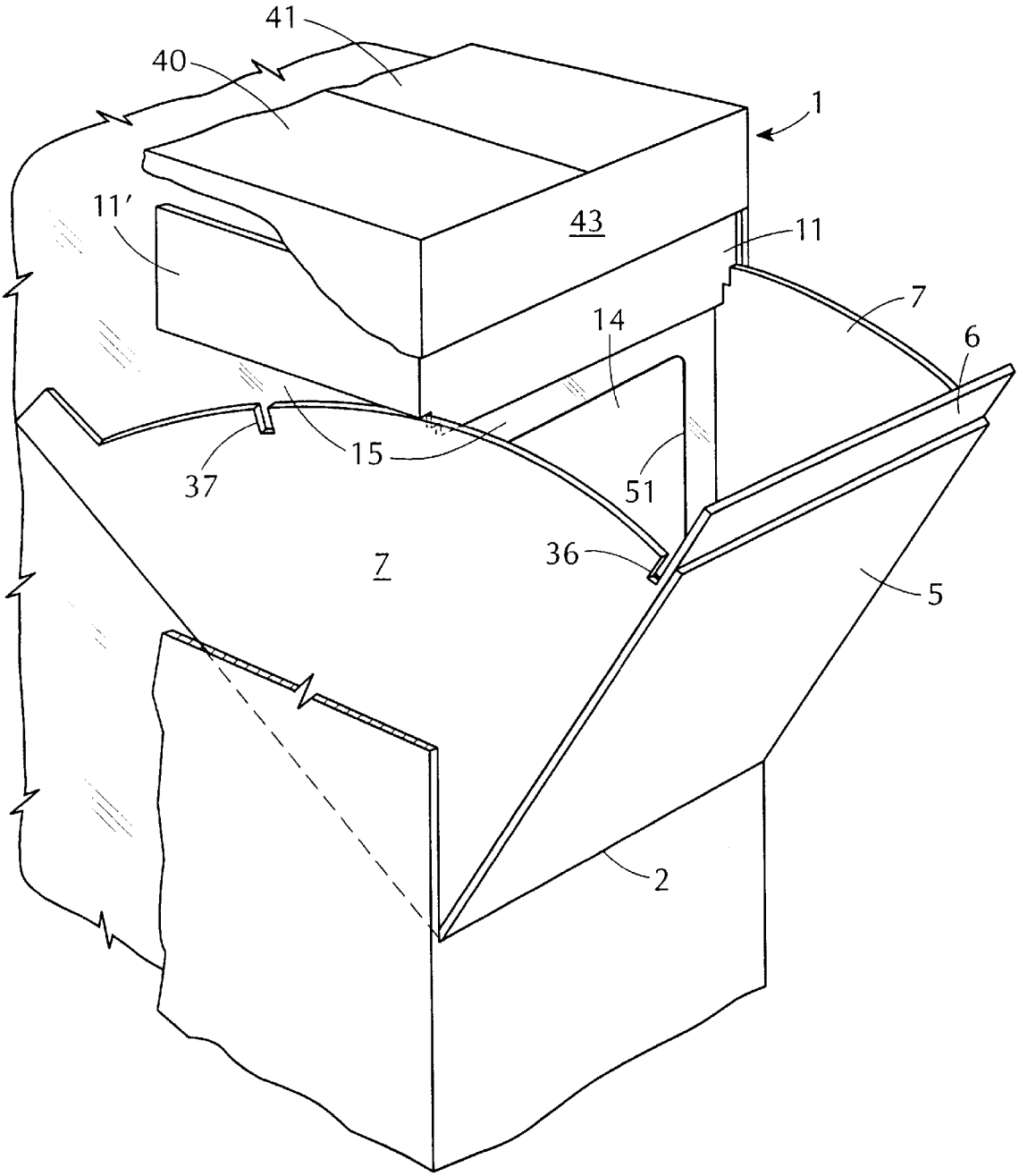
FIGS. 3A and B are perspective views, partly broken away, showing the dispensing assembly partly open and fully open.
Figure 6:
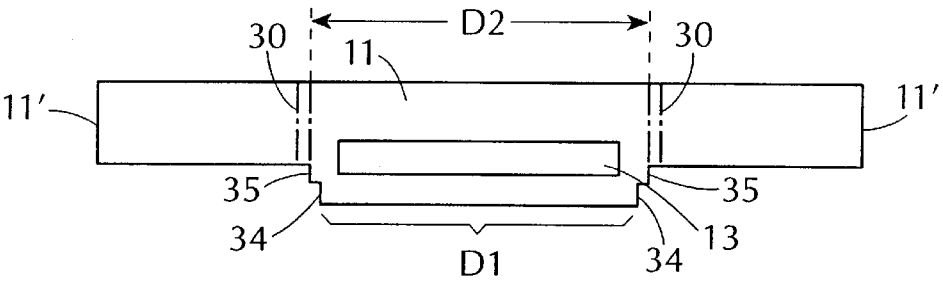
FIG. 6 is a plan view of a top insert laid flat with its interior surface facing upward.

In a preferred embodiment, with reference to FIG. 6, the pour spout incorporates an upper member having a center section 11 and side members 11' which fold along fold lines 30. Center section 11 and side members 11' are adhered to the interior of side and end walls 42 and 43 with center section 11 positioned as shown in FIGS. 1B and 3A such that the upper portion of front panel 6 covers section 11 and terminates at line 4' in end wall 43.

Center section 11 has two step down sections which interact with the side panels 7 and notches 36 and 37. The first step down section has detents or ends 34 and a width D1 which corresponds to width D1 of front panel 6. The second step down member has similar detents or ends 35 and a width D2 which is slightly larger than D1, the width of front panel 6, and thus slightly larger than the width of end wall 43. This provides a snap fit for opening and closing the pour assembly 3. When partly open as shown in FIG. 3A, side panels 7 pivot between side walls 42 and ends 35 of center section 11. As the front panel 6 pivots to an open position, ends 35 enter notches 37 because the distance D2 between ends 35, being greater than width D2 of panel 6, is also greater than the distance between notches 37. In the open position, side panels 7 now rest against ends 34 of section 11 to keep them approximately parallel to side walls 42.

Figure 3E:
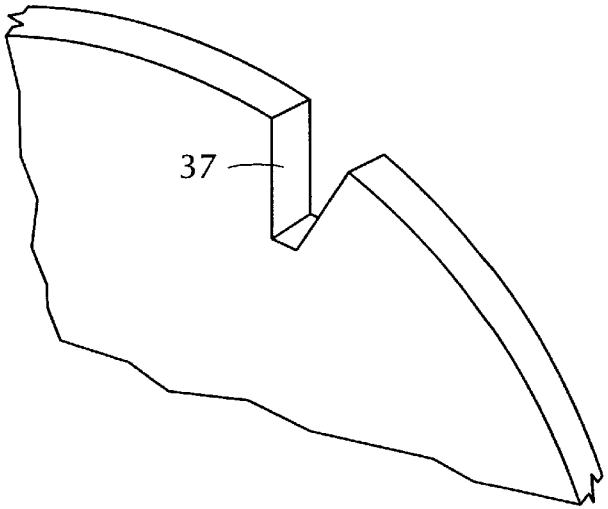
FIG. 3E is a perspective view of an alternate notch shape.
Figure 3B:
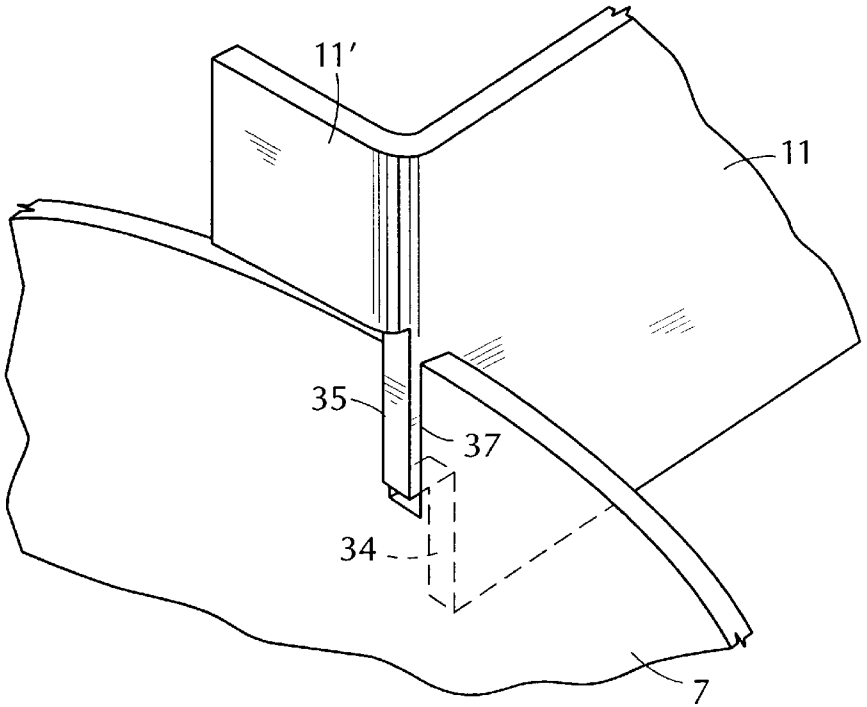
FIGS. 3C and D are partial cross-sectional views showing the dispensing opening partly open and fully closed.
Figure 3D:
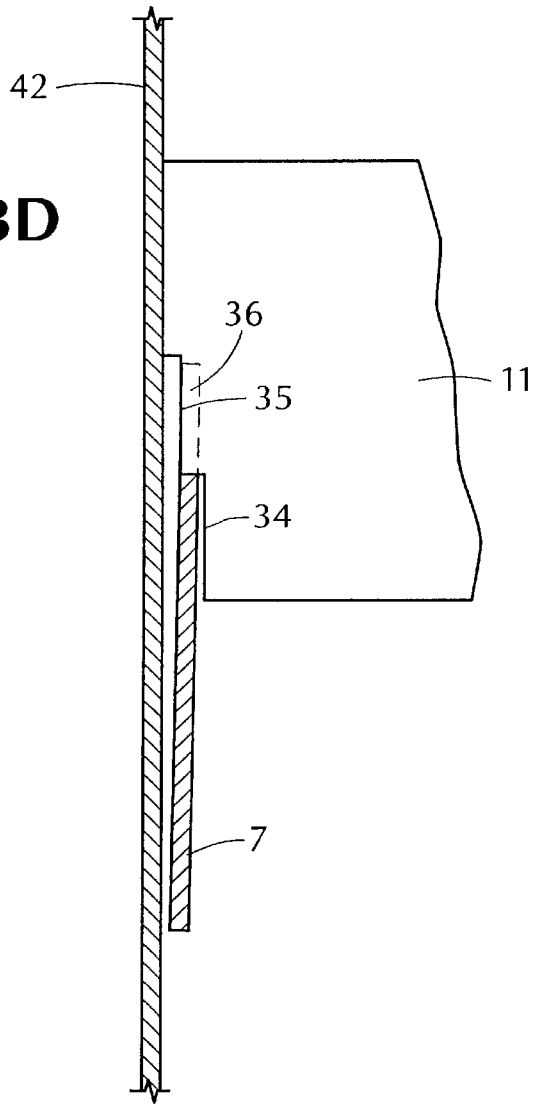
Figure 3C:
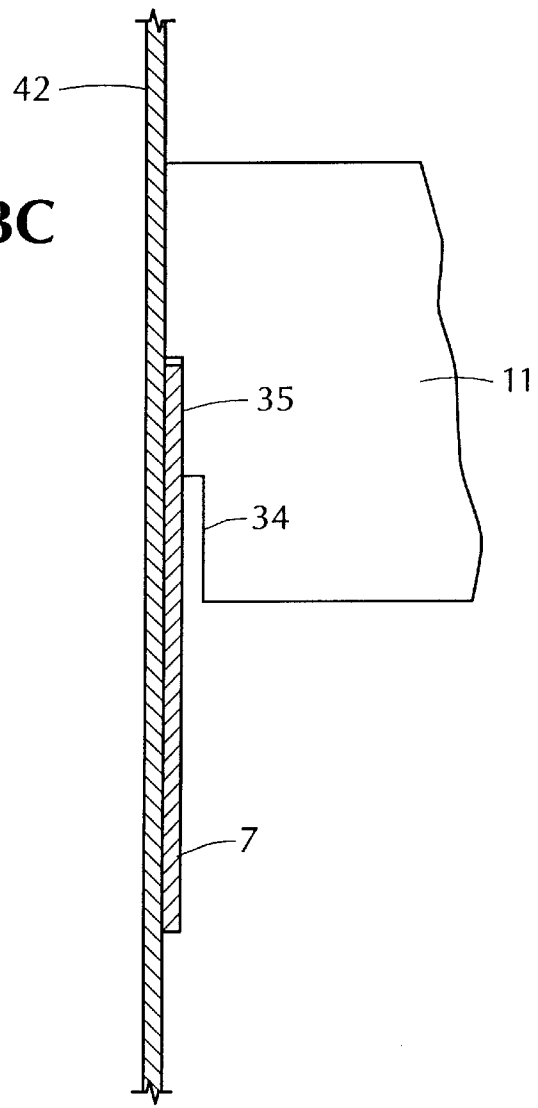

When the pour spout is closed, ends 35 enter notches 36 with adjacent portions of side panels 7 again resting against ends 34 (FIG. 3D). This provides a snap like opening and closing by virtue of the greater distance between ends 35 and notches 37 in the open position and notches 36 in the closed position.

FIG. 3E shows an alternate V shaped configuration for notch 37 in side walls 7 to facilitate opening and closing of the pour spout 3.

As shown in FIGS. 2, 5 and 6, front panel 6 carries means 9 for promoting bonding of a portion of the liner bag 15 to front panel 6 of the pour spout. Similar means 13 to bond liner 15 to end wall 43 above the pour spout are positioned on center section 11 facing the interior of the carton.

Bonding means 9 is shown to have a generally rectangular shape which defines that portion of the liner bag 15 that separates from the liner as the pour spout pivots to open for the first time. Bonding member 9 can have dimensions approximating the rectangular shape of the front panel 6 or it can be reduced in size as shown in FIGS. 2 and 5.

Figure 4B:
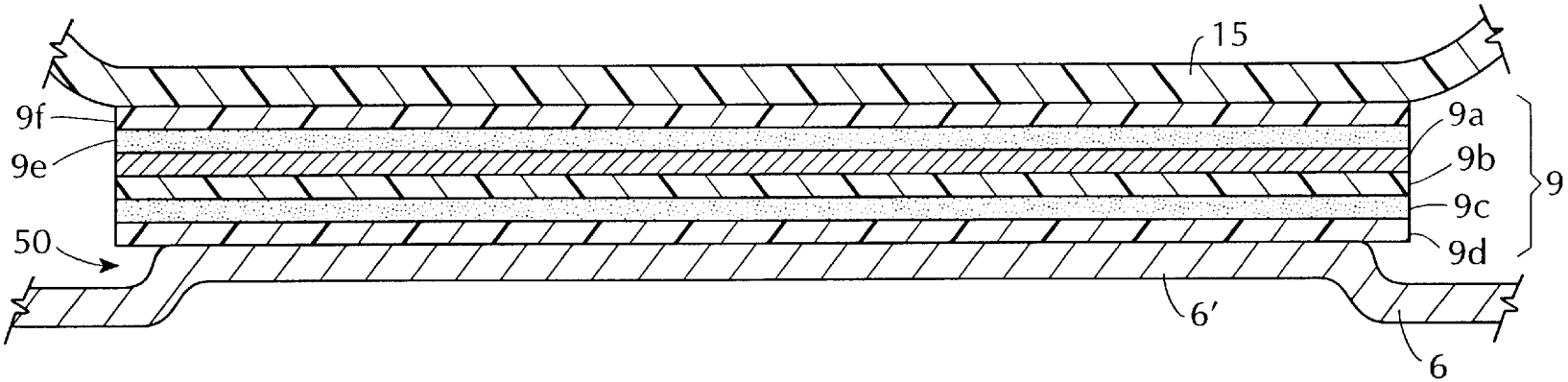
FIG. 4A is a plan view of the interior of a front panel of the dispensing assembly and FIG. 4B, 4C, 4D and 4E are cross-section views showing means to promote bonding between the front panel and the liner.
Figure 4C:
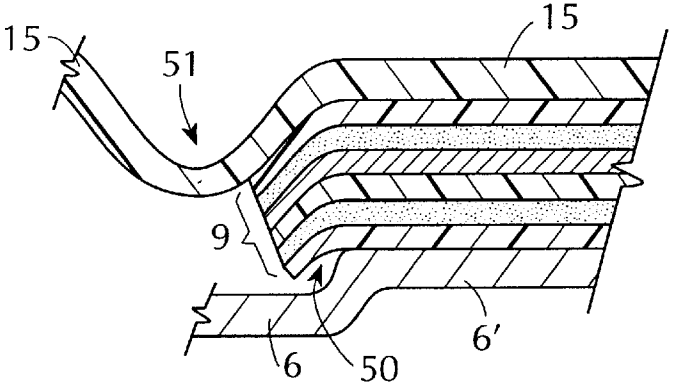
Figure 4A:
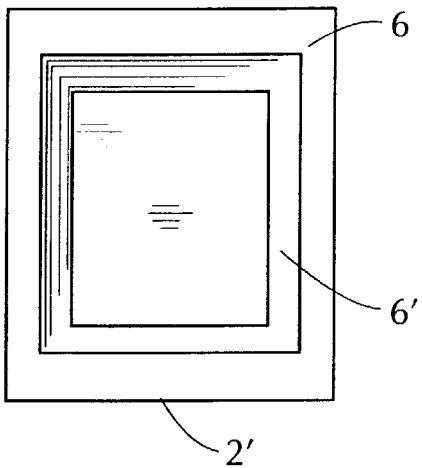

In the embodiment shown, bonding member 9 is adhered to a raised portion 6' of front panel 6 which corresponds approximately to the rectangular shape of member 9. See FIG. 4A. As shown in FIG. 4B, member 9 includes a layer of metal foil 9*a* such as aluminum foil or vacuum metalized aluminum adhered to polyester layer 9*b*. Adhesive layers 9*c* and 9*e* flank both sides of the polyester/foil laminate. Linear low density polyethylene adhesive layers define the outermost layers 9*d* and 9*f*. The overall thickness of member 9 is about 5 mils and it can be adhered to raised area 6' of front panel 6 by spot glueing for positioning purposes. Bonding member 13 is of a similar construction and can also be spot glued in the position shown in FIG. 3A. Spot glueing of members 9 and 13 is preferred so as to activate both adhesive layers 9*d* and 9*f* at the same time as described below.

As shown in FIG. 4B, foil laminate 9 overlaps the edges of raised area 6' leaving air gaps 50. In the embodiment shown, carton 1 contains a filled and sealed liner bag 15. In order to bring liner bag 15 into contact with bonding laminate 9 and the front panel 6, referring to FIG. 7, the filled carton is passed through enclosure 70 via air locks 72 and 73 which maintain an area of reduced pressure in the enclosure 70 via vacuum generator 71. Because sealed liner bag 15 contains atmospheric air, the application of a vacuum has the effect of inflating liner bag 15 forcing it tightly against the interior of the carton including foil laminate 9 and front panel 6. While in this state, the carton 1 enters a heating zone provided by induction heating device 21. A suitable induction heater is a Model XP20 made by Ameritherm Inc. Induction heat provided by member 21 heats the metal foil laminate member 9 which in turn activates adhesive layers 9*d* and 9*f*. Adhesive layer 9*d* adheres the foil laminate member 9 to raised area 6' of front panel 6 while adhesive layer 9*e* adheres the plastic liner bag 15 to the front panel 6 in an area defined by the rectangular shape of metal foil laminate member 9. Because member 9 overlaps raised area 6' leaving air spaces 50, (FIG. 4C) heat generated by foil layer 9*a* becomes concentrated at the edges of the member 9 in the area of overhang which stretches and thins the bag liner 15 in the area shown by reference numeral 51. This thinning provides a score line in the bag liner 15 around the edges of member 9 to facilitate initial opening of the pour spout. When liner 15 is forced into contact with member 9 under vacuum, tension is created which results in a stretching effect along the overhanging edges of metal foil laminate member 9. The application of heat while in a stretched state results in an area of reduced thickness and an easily rapturable score line around the outside edges of member 9.

Figure 7:
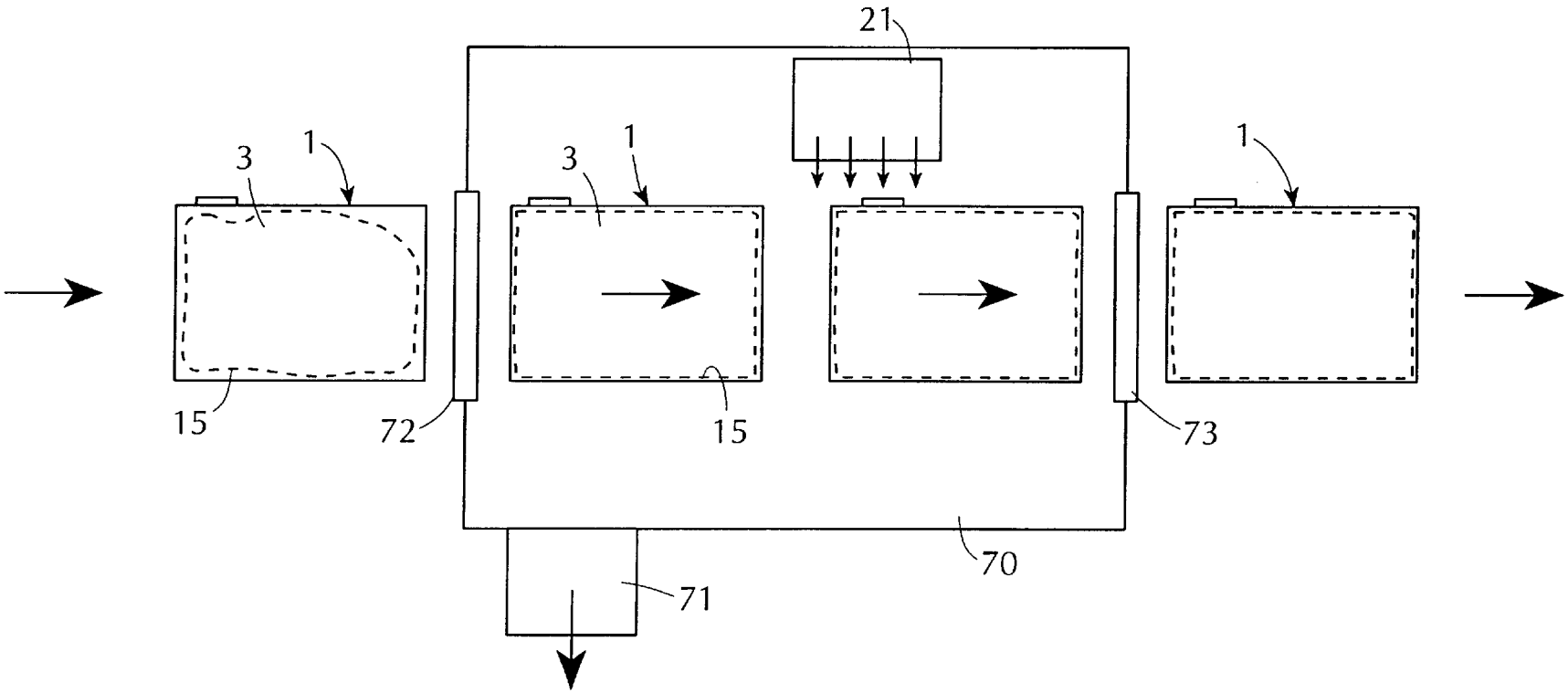
FIG. 7 is a diagrammatic view of apparatus for sealing the liner to the front panel of the pour spout.

Upon initial opening of the pour spout 3, that is, while front panel 6 is pulled outward to disengage notches 36 and end members 35, a portion 16, (FIG. 2), of liner bag 15 remains bonded to panel 6 via member 9 and separates on three sides 16*a*, 16*b* and 16*c* corresponding to the thinned or weakened score line formed in the area of 51 around the edges of the member 9. Thus, as the open position is reached, portion 16 of liner bag 15 separates from the main body of the liner bag and remains integral therewith along the pivot axis 2'. Upon reclosing the pour spout, side panels 7 cooperate with ends 34 and 35 on member 11 to maintain alignment between portion 16 and opening 14 in the liner bag 15. To help maintain alignment of the liner bag opening 14 with the pour spout assembly, metal foil laminate member 13 is positioned as shown in FIG. 6 to bond the liner bag adjacent the opening 14 above the opening formed by the dispensing assembly itself. Further alignment means can be provided by a series of dots or circles 13' (FIG. 1B) of the same metal foil laminate as member 9 positioned on side panels 42 adjacent the periphery of the side panels 7 when the pour spout is in a closed position. Members 13 and 13' bond the liner bag 15 to the carton walls via induction heating at the same time member 9 bonds the liner bag to front panel 6 (FIG. 7).

Figure 4D:
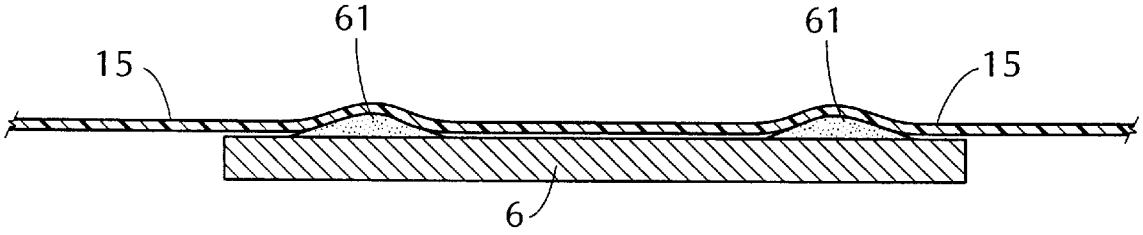
Figure 4E:
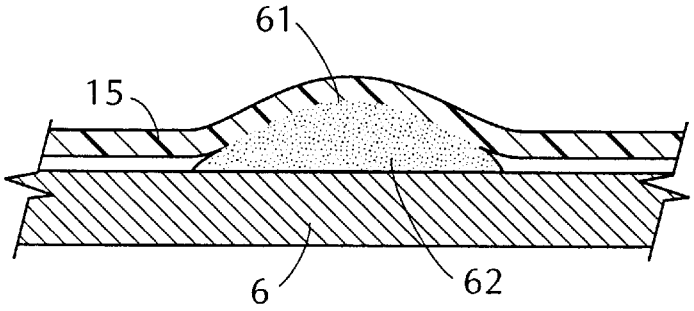

FIGS. 4D and E show an alternate embodiment wherein a bead of hot melt adhesive 62 is applied to front panel 6 in the same pattern as member 9. The hot melt adhesive can be premixed with metal particles such as iron or aluminum or bead 62 can be flocked while still hot with iron or aluminum particles 61. A magnet can be used to orient iron particles 61 for better bonding to film 15 (FIG. 4E).

Figure 8:
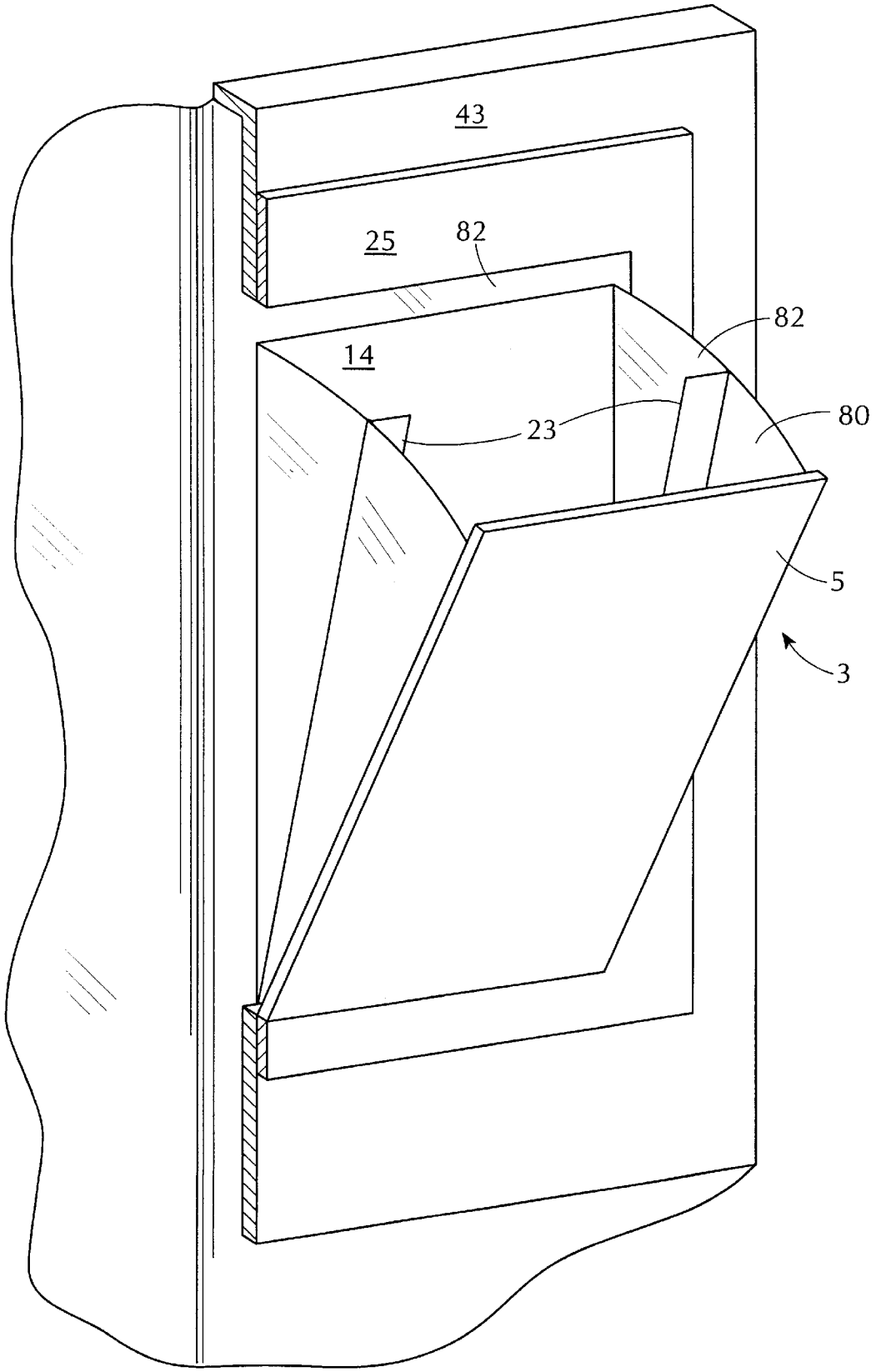
FIG. 8 is a perspective view of an alternate embodiment of the present invention partly broken away.

FIG. 8 is a perspective of an alternate embodiment for a container of the present in invention. The pour spout 3 includes bezel 25 that is affixed directly to end wall 43, front panel 5 that is hingedly attached to bezel 7, and flexible side panels 80 which are attached to front panel 5 by conventional adhesive. Side panels 80 bond to liner 15 at seams 23. Bonding between the side panels 80 and the liner 15 is achieved by the process shown in FIG. 7.

Figure 9:
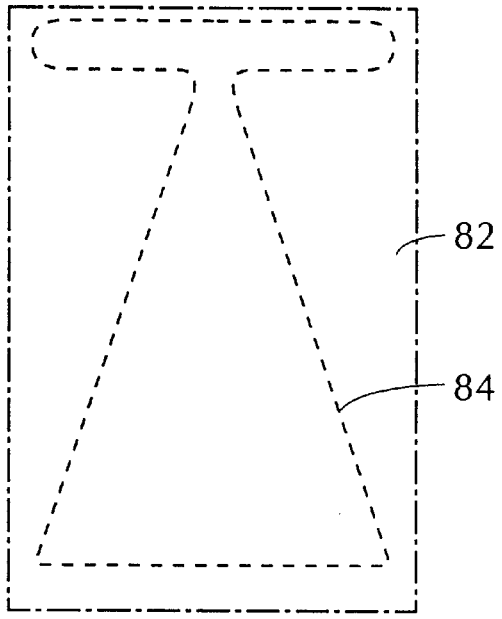
FIG. 9 shows a perforation pattern on the liner of the embodiment of FIG. 8.

When the pour spout is opened for the first time, flexible side panels 80 pull and tear the liner 15 along lines of perforation 84 shown in FIG. 9. As flexible side panels 80 pull liner 15, portions 82 the liner extend and form the side walls spout 3 with side panels 80.

Figure 10:
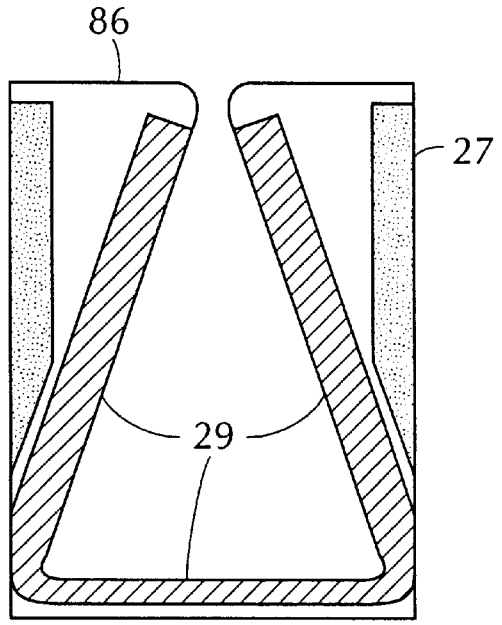
FIG. 10 is a plan view of a material which partly forms the side panels of the embodiment of FIG. 8.

Flexible side panels 80 are preferably formed by a single sheet of flexible material 86 as shown in FIG. 10 with conventional adhesive 27 applied to the edge which bonds to the pour spout front panel 5. Foil laminate bonding member 29 (similar to member 9) bonds to corresponding edges of portions 82 of liner 15 to form seams 23 in the side panels 80, 82.

What is claimed is:

1. Dispensing assembly comprising:

(a) a carton having a dispensing opening in a side wall thereof and a separate liner therein;

(b) a pour spout mounted to said dispensing opening pivotable between open and closed positions and including a front panel having a raised area upon which means to promote bonding to said liner is applied;

(c) said liner being bonded to said raised area whereby upon initial opening of the pour spout that portion of the liner bonded to said raised area separates from said liner providing access to the interior thereof.

2. Dispensing assembly of claim 1 wherein said means to promote bonding comprises means for generating heat and a heat activatable adhesive.

3. Dispensing assembly of claim 2 wherein the means for generating heat is selected from the group consisting of metal foil, metallic salt and metal particles.

4. Dispensing assembly of claim 1 wherein said means to promote bonding is a metal foil laminate which overhangs said raised area so as to score the liner along a separation line upon activation of the heat activatable adhesive.

5. Dispensing assembly of claim 1 further comprising means for locking said pour spout in its open and closed positions.

6. Dispensing assembly of claim 5 wherein said means further comprising means for locking having mating notches and detent means.

7. Dispensing assembly comprising:

(a) a carton having a dispensing opening in a side wall thereof and a separate liner therein, (b) a pour spout mounted to said dispensing opening pivotable between open and closed positions and including a front panel;

(c) a member mounted to the interior of said carton and extending into said dispensing opening; and (d) said liner being bonded to said member and said front panel whereby upon initial opening of the pour spout that portion of the liner bonded to the front panel separates from said liner providing access to the interior thereof.

8. Dispensing assembly of claim 7 wherein said member includes means to promote bonding with said liner means.

9. Dispensing assembly of claim 8 wherein said means to promote bonding comprises heat generating means and heat activatable adhesive means.

10. Dispensing assembly of claim 9 wherein the heat generating means is at least one member selected from the group consisting of a metal foil, metallic salt and metal particles.

11. Process for making a dispensing assembly comprising:

(a) providing a carton having a dispensing opening in a side wall thereof and a pour spout mounted to said dispensing opening, said pour spout being pivotable between open and closed position and including a front panel having a raised area; and (b) bonding said liner to said raised area such that upon initial opening of the pour spout that portion of the liner bonded to said raised area separates from said liner providing access to the interior of the carton.

12. Process of claim 11 wherein said liner is filled and sealed and said liner portion is brought into contact with said front panel and bonded thereto.

13. Process of claim 12, further comprising exposing said carton to an area of reduced pressure to bring a portion of said liner into contact with said front panel for bonding thereto.

14. Process of claim 11 further comprising providing said front panel with means to promote bonding to said liner and providing bonding energy to the interface between said front panel and said portion of the liner to bond said liner portion to said front panel at said interface.

15. Process for preparing a dispensing assembly comprising:

(a) providing a carton having a dispensing opening in a side wall thereof and a separate liner therein, the carton having a pour spout mounted to said dispensing opening pivotable between open and closed positions and including a front panel;

(b) mounting a member to the interior of said carton and extending into said dispensing opening; and (c) bonding said liner to said member an said front panel whereby upon initial opening of the pour spout that portion of the liner bonded to the front panel separates from said liner providing access to the interior thereof.

16. Process of claim 15 wherein said liner is filled and sealed and said liner portion is brought into contact with said front panel and said member and bonded thereto.

17. Process of claim 16, further comprising exposing said carton to an area of reduced pressure to bring a portion of said liner into contact with said front panel and said member for bonding thereto.

18. Process of claim 15 further comprising providing said front panel and said member with means to promote bonding to said liner and providing bonding energy to the interfaces between said each of said front panel and said member with the liner to bond said liner portion with said front panel and said member at said interfaces.

* * * * *

UNITED STATES PATENT AND TRADEMARK OFFICE

CERTIFICATE OF CORRECTION

PATENT NO. : 6, 062, 467

DATED : May 16, 2000

INVENTOR(S) : Ours et al.

It is certified that error appears in the above-identified patent and that said Letters Patent is hereby corrected as shown below:

In column 3, line 29, after "LOK$^{R}$" insert - - & - -.

Signed and Sealed this

First Day of May, 2001

*Attest:*

Nicholas P. Godici

NICHOLAS P. GODICI

*Attesting Officer*

*Acting Director of the United States Patent and Trademark Office*